US008393979B2

(12) United States Patent
Fitchett

(10) Patent No.: US 8,393,979 B2
(45) Date of Patent: Mar. 12, 2013

(54) GOLF BALL WITH HYDROPHILIC COATING LAYER

(75) Inventor: Derek A. Fitchett, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 159 days.

(21) Appl. No.: 12/822,470

(22) Filed: Jun. 24, 2010

(65) Prior Publication Data

US 2011/0319197 A1 Dec. 29, 2011

(51) Int. Cl.
*A63B 37/12* (2006.01)

(52) U.S. Cl. ..... 473/378; 473/384

(58) Field of Classification Search ..... 473/378, 473/384

See application file for complete search history.

(56) References Cited

U.S. PATENT DOCUMENTS

| | | | | |
|---|---|---|---|---|
| 4,073,983 | A | 2/1978 | Van Cleave | |
| 4,660,834 | A | 4/1987 | Carrigan | |
| 5,040,795 | A | 8/1991 | Sonntag | |
| 5,266,669 | A | 11/1993 | Onwunaka et al. | |
| 5,334,691 | A | 8/1994 | Gould et al. | |
| 5,816,943 | A | 10/1998 | Masutani et al. | |
| 5,823,891 | A * | 10/1998 | Winskowicz | 473/378 |
| 5,938,544 | A * | 8/1999 | Winskowicz | 473/378 |
| 5,962,620 | A * | 10/1999 | Reich et al. | 528/76 |
| 6,017,625 | A | 1/2000 | Sato et al. | |
| 6,277,037 | B1 * | 8/2001 | Winskowicz et al. | 473/378 |
| 6,308,623 | B1 | 10/2001 | Schonberger et al. | |
| 6,358,160 | B1 * | 3/2002 | Winskowicz | 473/378 |
| 6,450,901 | B1 | 9/2002 | Binette et al. | |
| 6,610,382 | B1 | 8/2003 | Kobe et al. | |
| 6,645,099 | B2 | 11/2003 | Gaff et al. | |
| 6,787,487 | B1 | 9/2004 | Takeda et al. | |
| 6,794,027 | B1 | 9/2004 | Araki | |
| 6,811,497 | B1 | 11/2004 | Jones et al. | |
| 6,893,360 | B2 * | 5/2005 | Brown | 473/351 |
| 7,244,193 | B2 * | 7/2007 | Emalfarb | 473/351 |
| 7,427,243 | B2 | 9/2008 | Sullivan | |
| 7,484,735 | B2 | 2/2009 | Verbrugge et al. | |
| 7,549,936 | B2 | 6/2009 | Ladd et al. | |
| 7,601,079 | B2 * | 10/2009 | Sullivan | 473/378 |
| 2003/0104880 | A1 * | 6/2003 | Fushihara | 473/378 |
| 2003/0232666 | A1 | 12/2003 | Sullivan | |
| 2004/0224792 | A1 * | 11/2004 | Brown | 473/378 |

(Continued)

FOREIGN PATENT DOCUMENTS

| | | |
|---|---|---|
| DE | 4408615 | 9/1995 |
| DE | 202004014864 | 2/2005 |

(Continued)

OTHER PUBLICATIONS

European Search Report dated Nov. 4, 2011 in European Patent Application No. 11 16 9806.

*Primary Examiner* — Gene Kim
*Assistant Examiner* — Matthew B Stanczak
(74) *Attorney, Agent, or Firm* — Plumsea Law Group, LLC

(57) ABSTRACT

This disclosure provides a golf ball having a coating layer made from a hydrophilic water-swellable material. The hydrophilic water-swellable material undergoes a physical change from a dry state to a wet state upon exposure to water. The wet state may be associated with shallower dimple depths, and the coating layer being softer, than the dry state. The use of such a coating layer may allow the golf ball to compensate for the negative effects of wet weather conditions. Also provided is a method of manufacturing a golf ball.

15 Claims, 8 Drawing Sheets

U.S. PATENT DOCUMENTS

| | | | | |
|---|---|---|---|---|
| 2005/0227789 | A1 | 10/2005 | Winskowicz et al. | |
| 2005/0269737 | A1 | 12/2005 | Hogge et al. | |
| 2006/0276265 | A1* | 12/2006 | Sullivan | 473/371 |
| 2007/0117662 | A1 | 5/2007 | Ma | |
| 2007/0155542 | A1 | 7/2007 | Sullivan et al. | |
| 2007/0213143 | A1 | 9/2007 | Chinn et al. | |
| 2008/0081710 | A1 | 4/2008 | Chen et al. | |
| 2008/0220907 | A1 | 9/2008 | Aoyama et al. | |
| 2009/0023516 | A1 | 1/2009 | Rajagopalan et al. | |
| 2009/0221386 | A1 | 9/2009 | Ladd et al. | |
| 2009/0291120 | A1 | 11/2009 | Tuominen et al. | |
| 2011/0177884 | A1 | 7/2011 | Ichikawa et al. | |

FOREIGN PATENT DOCUMENTS

| | | |
|---|---|---|
| EP | 2353665 | 8/2011 |
| JP | 2002102388 | 4/2002 |

* cited by examiner

GOLF BALL WITH HYDROPHILIC COATING LAYER

BACKGROUND

The present disclosure relates generally to the field of golf balls. Specifically, the present disclosure relates to a golf ball having a coating layer that is hydrophilic in such a manner as to cause the coating layer to swell.

The game of golf is an increasingly popular sport at both the amateur and professional levels. A wide range of technologies related to the manufacture and design of golf balls are known in the art. Such technologies have resulted in golf balls with a variety of play characteristics. A golfer may use different golf balls having different play characteristics depending on, for example, the golfer's preferences or the play conditions. For example, different dimple characteristics may affect the aerodynamic properties of the golf ball during flight, or a difference in the hardness of the cover layer may affect the rate of backspin.

A wide variety of dimple characteristics are known to affect the golf ball's aerodynamic properties, such as the dimple pattern, dimple shape and dimple depth. Ideally, the dimples should be designed to achieve the greatest possible flight distance by achieving reduced drag and increased lift. As is generally known, drag is the air resistance that opposes the golf ball's flight direction. Drag is caused by the difference between high air pressure in front of the golf ball and low air pressure in the golf ball's wake. The dimples cause a thin boundary layer of air bordering the golf ball's outer surface to flow in a turbulent manner. The turbulent boundary layer moves the separation point backward, so that the boundary layer stays adjacent to the golf ball further along the ball's outer surface. As a result, the area of the wake is reduced and the pressure behind the ball is increased. Drag is thereby reduced, and the golf ball achieves increased flight distance.

As is also generally known, lift is an upward force on the golf ball that is created by a difference in pressure between the top of the ball and the bottom of the ball. Due to the golf ball's backspin, the top of the ball moves in the same direction as the airflow, which moves the air separation point to a location further backward. Conversely, the bottom of the ball moves against the airflow, which moves the separation point forward. This asymmetrical separation creates an arch in the flow pattern, whereby air that flows over the top of the ball moves faster than the air that flows along the bottom of the ball. As a result, the air above the ball is at a lower pressure than the air underneath the ball. This pressure difference results in the overall force, lift, which is exerted upwardly on the ball. Lift therefore causes the golf ball to achieve increase flight distance, as the upward lift force keeps the golf ball in the air for a longer period of time.

Dimple depth, in particular, can significantly affect the aerodynamics of the golf ball's flight. As is generally known, shallower dimples tends to result in the golf ball rising higher during flight. Conversely, the deeper the golf ball dimples, the lower the golf ball's flight. It is believed that these tendencies are caused by decreased lift due to greater turbulence of the air inside deeper dimples, although many different aerodynamic phenomenon likely come into play.

Similarly, the hardness of the golf ball's outer layer(s) can also significantly affect a golf ball's play characteristics. Generally, a golf ball with a harder cover layer will achieve reduced spin, but will achieve greater distances. A golf ball with a harder cover layer will therefore be better for drives, but more difficult to control on shorter shots. On the other hand, a golf ball with a softer cover will generally experience more spin and therefore be easier to control and stop on the green, but will lack distance off the tee.

Consequently, a golfer may desire to use a golf ball having different dimple depths or different cover layer hardness, depending on a variety of factors. For example, weather conditions or the golfer's athletic abilities may affect whether shallow dimples or deeper dimples, or a harder cover layer or a softer cover layer, will better achieve the desired play characteristics.

In particular, wet play conditions due to rainy weather can significantly affect a golf ball's play characteristics. During wet weather, the presence of water on the surface of the golf ball decreases friction between the golf club face and the golf ball. This decreased friction causes the golf ball to experience a lower trajectory flight path, and also decreases spin on the ball. This decreased spin reduces the amount of control the golfer has over the golf ball's flight path and landing conditions. Wet weather conditions therefore present specific challenges to achieving optimal golf ball play characteristics.

Amateur golfers generally prefer to minimize the costs of purchasing new golf balls. However, a golfer may be required to purchase several sets of golf balls in order to achieve different play characteristics. Namely, a golfer may be required to purchase one set of golf balls for use in normal weather conditions and another separate set of golf balls for use in wet weather conditions. The need to purchase, store and carry several sets of golf balls in order to achieve a variety of play characteristics presents an inconvenience to the golfer, as well as increased costs.

Therefore, there is a need in the art for a golf ball and method that addresses the shortcomings of the prior art discussed above.

SUMMARY

In one aspect, the present disclosure provides a golf ball comprising a core; a cover layer substantially surrounding the core, the cover layer including at least one dimple, and at least one land area adjacent to the dimple; and a coating layer overlapping at least a portion of the cover layer; wherein the coating layer is comprised of a hydrophilic water-swellable material, such that the coating layer is configured to undergo a physical change from a dry state to a wet state upon exposure to water.

In another aspect the present disclosure provides a golf ball comprising a core; a cover layer substantially surrounding the core, the cover layer including at least one dimple, and at least one land area adjacent to the dimple; and a coating layer overlapping at least a dimple portion of the cover layer; wherein the coating layer is comprised of a hydrophilic water-swellable material, such that the coating layer is configured to physically change from a dry state to a wet state upon exposure to water; the dry state is associated with a first a first dimple depth, the wet state is associated with a second dimple depth, wherein the second dimple depth is less than the first dimple depth; and the dry state is associated with the coating layer having a first hardness, the wet state is associated with the coating layer having a second hardness, wherein the second hardness is softer than the first hardness.

In yet another aspect, the present disclosure provides a method of manufacturing a golf ball, the method comprising (1) a step of receiving a golf ball core substantially surrounded by a cover layer, the cover layer having at least one dimple and at least one land area adjacent to the dimple; (2) a step of coating at least a dimple portion of the cover layer with a coating layer, the coating layer being comprised of a hydrophilic water-swellable material such that the coating layer is configured to physically change from a dry state to a wet state upon exposure to water; wherein the dry state is associated with a first a first dimple depth, the wet state is associated with a second dimple depth, and the second dimple depth is less than the first dimple depth; and the dry state is associated with the coating layer having a first hardness, the wet state is associated with the coating layer having a second hardness, and the second hardness is softer than the first hardness.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Generally, the present disclosure relates to a golf ball having a coating layer comprised of a hydrophilic, water-swellable material. Specifically, in embodiments, at least one of the dimples is coated with the hydrophilic water-swellable material, and the coating physically changes upon exposure to water. The physical change may be, for example, a change in dimple depth, or a change in the hardness of the coating layer. The physical change may allow the golf ball to compensate for undesirable play characteristics that would otherwise occur in wet weather conditions.

Figure 1:
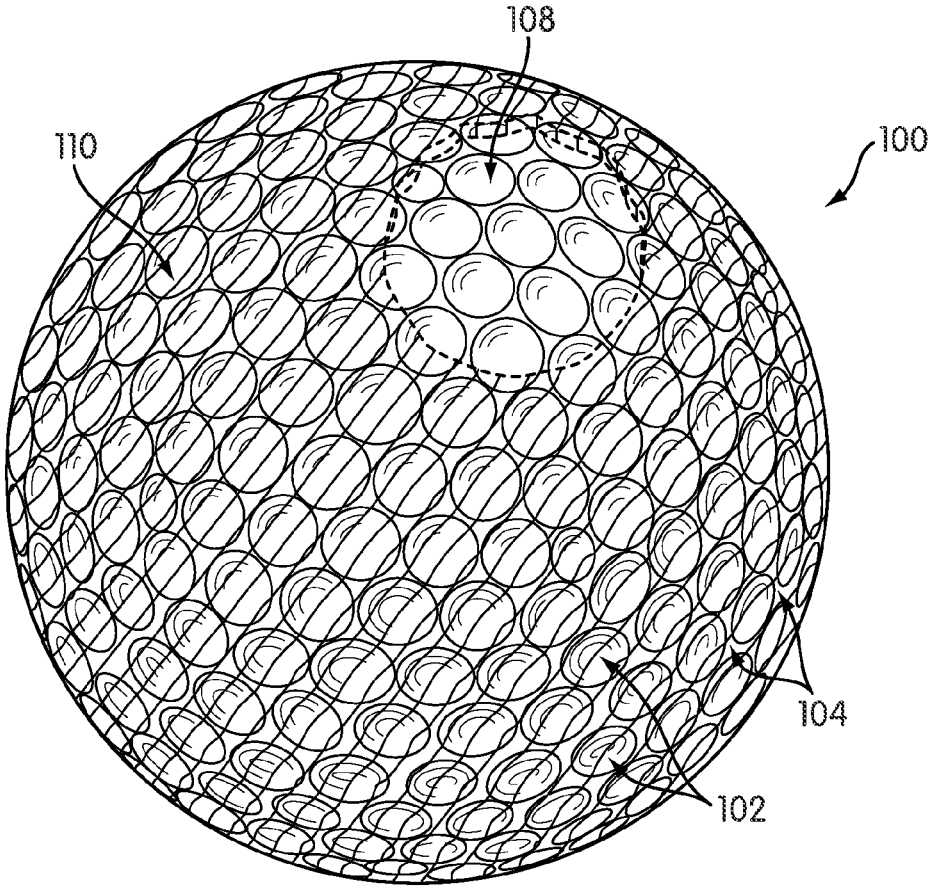
FIG. 1 shows a golf ball having a plurality of dimples and a land area separating the dimples.

FIG. 1 shows an embodiment of the present disclosure in golf ball 100. Golf ball 100 includes a plurality of dimples 102 and a land area 104 separating the dimples on the surface thereof. Except as otherwise discussed herein below, golf ball 100 may generally be any type of golf ball known in the art. Namely, unless the present disclosure indicates to the contrary, golf ball 100 may generally be of any construction conventionally used for golf balls, and may be made of any of the various materials known to be used in golf ball construction.

Golf ball 100 includes an outer coating layer 110. In the embodiment shown, coating layer 110 overlaps substantially the entirety of a cover layer 108. FIG. 1 reveals cover 108 beneath coating layer 110 through the dashed cutout view. Although FIG. 1 shows coating layer 110 as overlapping substantially the entirety of cover layer 108, in other embodiments coating layer 110 may overlap some portion of cover layer 108 that is less than the entirety of cover layer 108.

The plurality of dimples 102 may generally be arranged on cover layer 108 in any pattern, as may be known in the art of golf balls. Various known dimple packing patterns are known in the art. Dimples 102 may generally be of any shape, such as circular, triangular, or multi-sided. Dimples 102 may be of uniform shape and size, or the dimple pattern may be made up of two or more different types of dimples having (for example) different sizes or different shapes. At least one land area 104 is a part of cover layer 108 that separates at least two dimples 102 and that is not indented or otherwise part of a dimple. Generally, land area 104 is the "ridge" or "fret" between adjoining dimples 102. Golf ball 100 may include one continuous land area 104 across the entire cover layer, as is shown in FIG. 1, or a plurality of separate land areas between the plurality of dimples 102.

Figure 2:
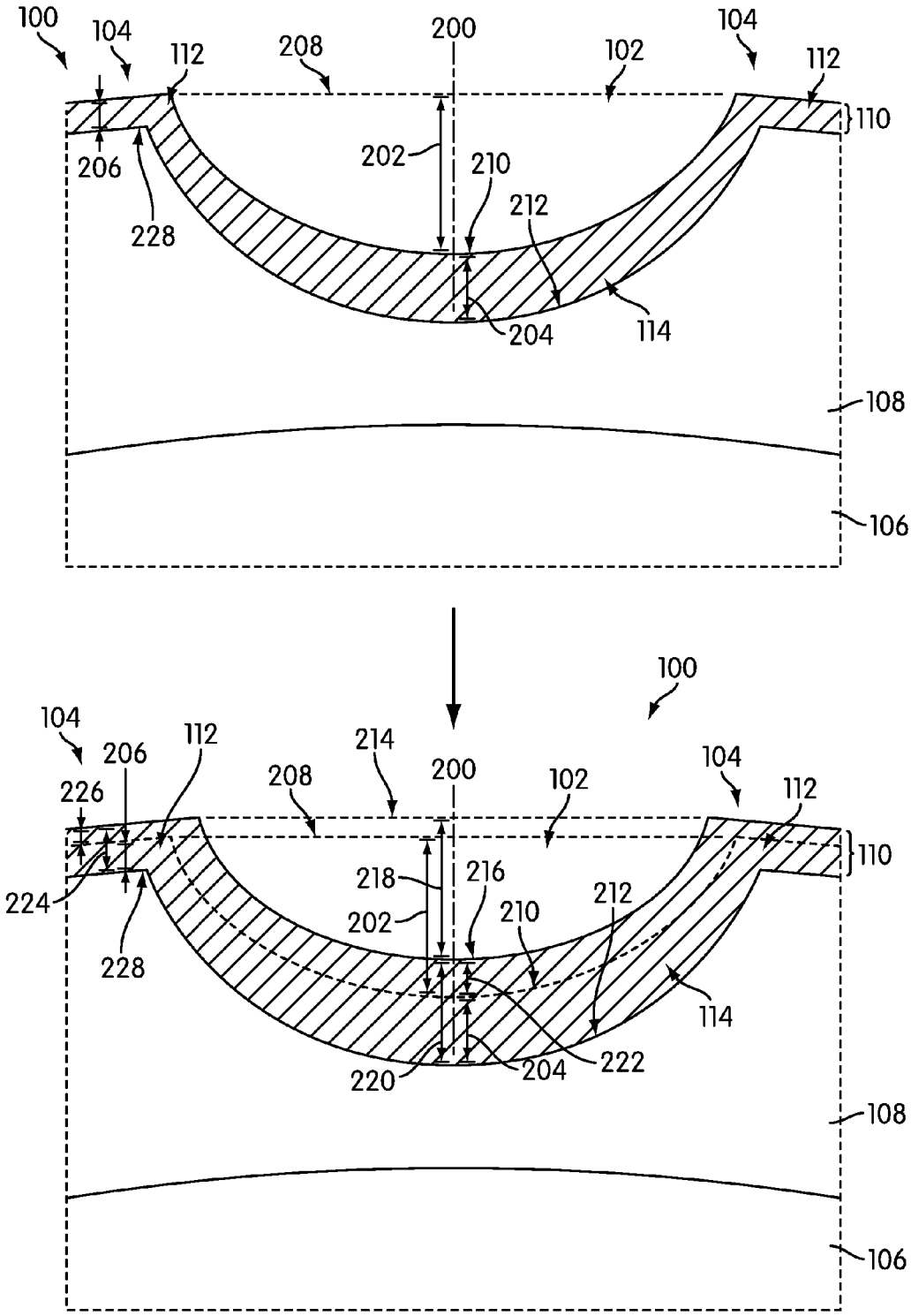
FIG. 2 shows two cross-sectional views of a single dimple on the golf ball of FIG. 1.

FIG. 2 shows a cross-sectional view of one particular dimple 102 on golf ball 100. In FIG. 2 three distinct parts of golf ball 100 are shown. A core 106 makes up the center of golf ball 100, a cover layer 108 substantially surrounds core 106, and coating layer 110 overlays cover layer 108 as shown. Although only these three components of golf ball 106 are shown in FIG. 2, golf ball 100 may include additional layers that are not shown. Such additional layers may include, for example, one or more additional inner layers between core 106 and intermediate layer 108, or one or more additional finishing layers. Additional inner layers may include layers commonly associated with "three piece" golf balls, "multi-piece" golf balls, or other additional inner layers. Finishing layers may include, for example, clear coating layers, cosmetic marking layers, or other finishing layers.

As shown in FIG. 2, cover layer 108 includes at least one dimple 102 and at least one land area 104 adjacent to dimple 102. Dimple 102 is defined as the area under line 208, where line 208 is defined by the upper most surface of land area 104. Coating layer 110 substantially overlaps cover layer 108, as shown. Cover layer 108 includes surface 212 where cover layer 108 and coating layer 110 meet in dimple 102, and surface 228 where cover layer 108 and coating layer 110 meet on land area 104.

In the embodiment shown in FIG. 2, coating layer 110 includes land portion 112 overlapping cover layer 108 at land portions 104. Coating layer 110 also includes dimple portion 114 overlapping cover layer 108 at dimple 102. Coating layer 110 land portion 112 has a first thickness 206, while coating layer dimple portion 114 has a second thickness 204. In the embodiment shown, second thickness 204 is greater than first thickness 206. However, in other embodiments, first thickness 206 and second thickness 204 may have other relative values.

Dimple 102 has a first dimple depth 202 in the top portion of FIG. 2. The top portion of FIG. 2 will generally be referred to as "the dry state" to denote the state of ball 100 before exposure to moisture levels sufficient to trigger absorption by ball 100. First dimple depth 202 is defined as the distance between first dimple bottom surface 210 and line 208. First dimple depth 202 as shown is measured at the center 200 of the dimple. However, the phrase "dimple depth" as used in the present disclosure need not necessary be measured at center 200 of dimple 102, but may generally be understood as the distance between the top 208 of dimple 102 and the bottom surface 210 of dimple 102 at any particular point, or (for example) as an average of this distance across dimple 102.

As shown in the lower portion of FIG. 2, coating layer 110 is configured to be capable of undergoing a physical change. The bottom portion of FIG. 2 will generally be referred to as "the wet state" to denote the state of ball 100 after exposure to moisture for a sufficient length of time so as to allow coating layer to absorb moisture. In the embodiment shown, the physical change is an expansion, such that coating layer 110 expands as it changes from the dry state to the wet state. The expansion causes the shape of the coating layer to change in various ways. For example, land portions 112 of the coating layer 110 expand from dry state thickness 206 to wet state thickness 224, the difference between these thicknesses being distance 226. Land portions 112 of coating layer 110 therefore have a wet state topmost surface 214. Furthermore, dimple portion 114 of coating layer 110 expands from dry state thickness 204 to wet state thickness 220, the difference between these thicknesses being distance 222. Dimple portion 114 of coating layer 110 therefore has a new wet state surface 216.

In the particular embodiment shown, the land portions 112 and the dimple portion 114 of coating layer 110 have the same linear swelling ratio. The linear swelling ratio, also referred to in the art as the linear swelling rate, is the ratio of the change in thickness to the original thickness, namely the ratio of distance 226 to distance 206, and the ratio of distance 222 to distance 204. In other embodiments, discussed below, the linear swelling ratios of the land portions and the dimple portion may be different.

More specifically, in particular embodiments, the expansion that occurs when the golf ball transitions from the dry state to the wet state may cause the dimple depth to change. In other words, the dry state may be associated with first dimple depth 202 while the wet state may be associated with a second dimple depth 218. Second dimple depth 218 is measured between wet state topmost land surface and wet state dimple bottom surface 216. Generally, second dimple depth 218 may be any dimple depth that is different from first dimple depth 202. However, in the particular embodiment shown, second dimple depth 218 is less than first dimple depth 202. In certain embodiments, second dimple depth 218 may be less than first dimple depth 202 by a specific percentage. For example, second dimple depth 218 may be 75% or less than dimple depth 202, or second dimple depth 218 may be 50% or less than first dimple depth 202, or second dimple depth 218 may be 33% or less than first dimple depth 202.

In the particular embodiment shown in FIG. 2, the change in dimple depth between the dry state and the wet state is caused by the difference in thickness of the land area portions 112 and the dimple portion 114 of the coating layer 110, even though the linear expansion ratio is the same in these two areas. In other words, the greater thickness 204 of the dimple portion 114 of coating layer 110 as compared to thickness 206 in the land portions 112 causes the distance 222 swelled in the dimple to be larger than the distance 226 swelled on the land.

With reference back to FIG. 1, the changes in dimple 102 shown in FIG. 2 may occur with respect to one or more of the plurality of dimples across the entirety of golf ball 100. In certain embodiments, fewer than all of the plurality of dimples may be configured to undergo a physical change from a dry state to a wet state. For example, a certain subset of the plurality of dimples arranged in a desired pattern may be configured to so change. Such a pattern may be, for example, spherically symmetric or non-spherically symmetric. Certain symmetric patterns of the dimples configured to change may meet United States Golf Association (U.S.G.A.) standards for regulation play golf balls. Specifically, a golf ball may include a pattern of dimples configured to change, such that the pattern of changeable dimples causes the golf ball to meet U.S.G.A. rules Section 7.3 standards for symmetry.

In other embodiments, as shown in FIG. 1, all of the plurality of dimples 102 may be configured to undergo a physical change from a dry state to a wet state. In other words, all of the dimples 102 on golf ball 100 may have the same first dimple depth 202 prior to any change in coating layer 110. Consequently, after a change in coating layer 110, all of the dimples 102 may have the same second dimple depth 218. The change in the dimples therefore may take place uniformly across all of the plurality of dimples.

In addition to the changes discussed above, coating layer 110 may undergo other physical changes when transitioning from the dry state to the wet state. For example, coating layer 110 may change hardness. The dry state may be associated with coating layer 110 having a first hardness, while the wet state may be associated with coating layer 110 having a second hardness. The first hardness and the second hardness may generally be of any hardness value commonly associated with golf ball outer layers, for example about 40 to about 80 on the Shore D scale. The first hardness and the second hardness may be different hardness values. In particular embodiments, the second hardness is softer (i.e. less hard) then the first hardness. In some embodiments, the second hardness is at least five units on the Shore D scale softer than the first hardness. In other embodiments, the second hardness is at least 10 units on the Shore D scale softer than the first hardness.

Coating layer 110 may be comprised of a hydrophilic water-swellable material. A hydrophilic water-swellable material may be any material that includes polar charges on the molecules therein capable of forming hydrogen bonds with water, and absorbs water so as to physically change dimension by swelling. The hydrophilic water-swellable material undergoes a physical change from the dry state to the wet state upon exposure to water. The nature of the hydrophilic water-swellable material is discussed in further detail below.

Figure 3:
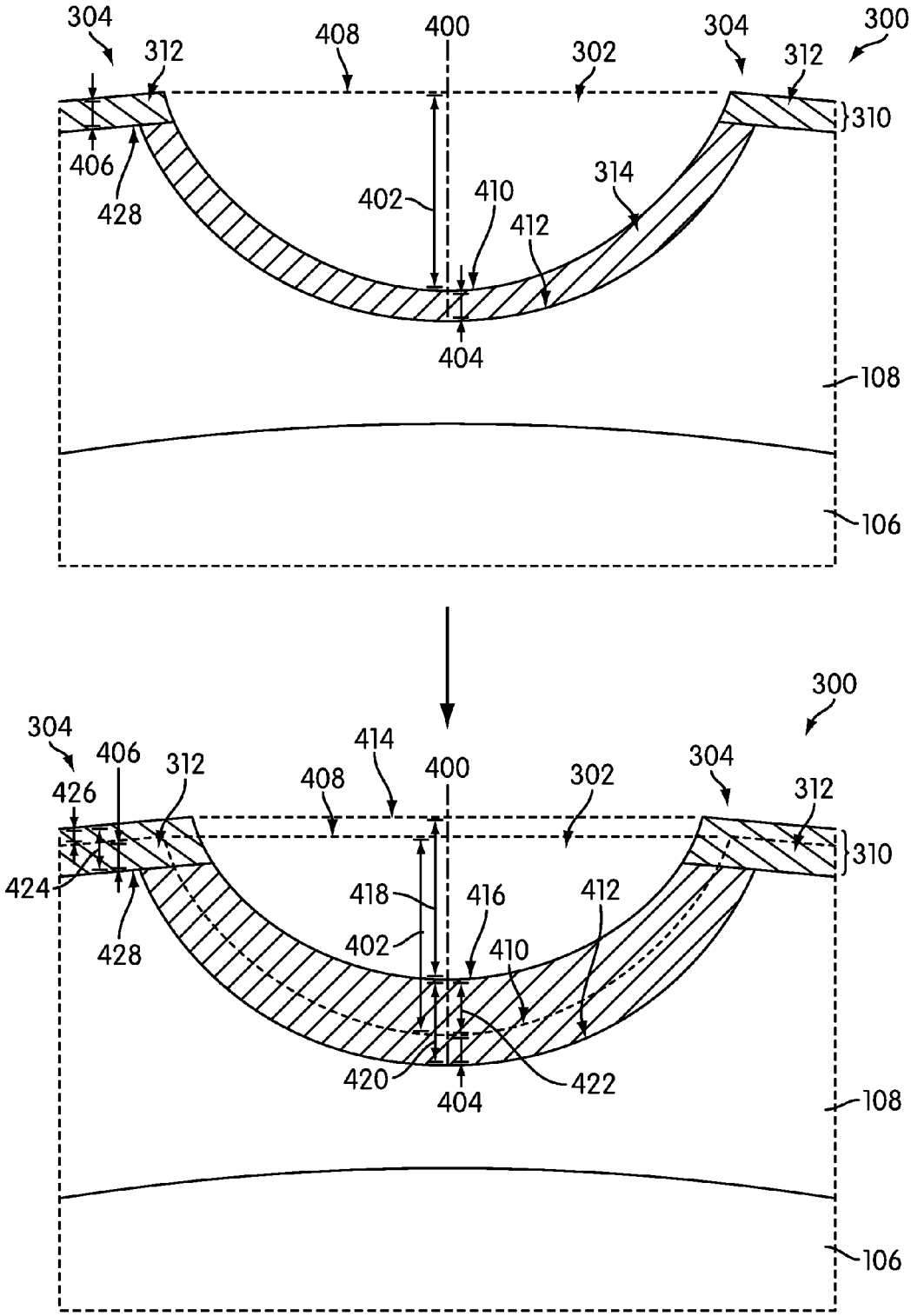
FIG. 3 shows two cross-sectional views of a single dimple on an alternative embodiment of a golf ball.

FIG. 3 shows a second embodiment of a golf ball 300 in accordance with the present disclosure. Golf ball 300 includes a coating layer 310 overlapping at least a dimple 302 portion of cover layer 108, and overlapping at least one land area 304 portion of cover layer 108. In this embodiment, land portion 312 of coating layer 310 comprises a first hydrophilic water-swellable material, and dimple portion 314 of coating layer 310 comprises a second hydrophilic water-swellable material. As shown in the top portion of FIG. 3, the thickness of coating layer 310 is constant throughout the dimple portion 314 and land portion 312 when in the dry state. Namely, thickness 404 (as measured between top surface 412 of cover layer 108 in dimple 302 and dry state dimple bottom surface 410) is the same as thickness 406 (as measured between top surface 428 of cover layer 108 in land area 304 and line 408). This contrasts with the embodiment of FIG. 2 wherein these portions have different thicknesses in the dry state (as well as in the wet state), as discussed above.

The embodiment of FIG. 3 allows for the use of two different materials having different linear swelling ratios. Namely, first hydrophilic water-swellable material 312 has a first linear swelling ratio, and second hydrophilic water-swellable material 314 has a second linear swelling ratio that is different from the first linear swelling ratio. In particular embodiments, the second linear swelling ratio is greater than the first linear swelling ratio.

Accordingly, when golf ball 300 transitions to the wet state, dimple portion 314 of coating layer 310 may swell a larger distance than land portions 312 swell. Specifically, dimple portion 314 swells from thickness 404 in the dry state to thickness 420 in the wet state. The difference between thickness 404 and thickness 420 is distance 422, as shown. On the other hand, land portions 312 swell from thickness 406 in the dry state to thickness 424 in the wet state. The difference between thickness 406 and thickness 424 is distance 426. In the particular embodiment shown, distance 422 may be larger than distance 426. The linear swelling ratio of dimple portion 314 is thus the ratio of distance 422 to distance 404, which is much larger than the linear swelling ratio of land portion 312 as defined by the ratio of distance 426 to distance 406. Therefore, dimple 302 has a first dimple depth 402 (as measured between dry state dimple bottom surface 410 and line 408 at dimple center 400) when in the dry state, and a second dimple depth 418 (as measured between wet state dimple bottom surface 416 and line 414, at center of dimple 400) when in the wet state. In the embodiment shown, second dimple depth 418 may be less than first dimple depth 402.

Figure 4:
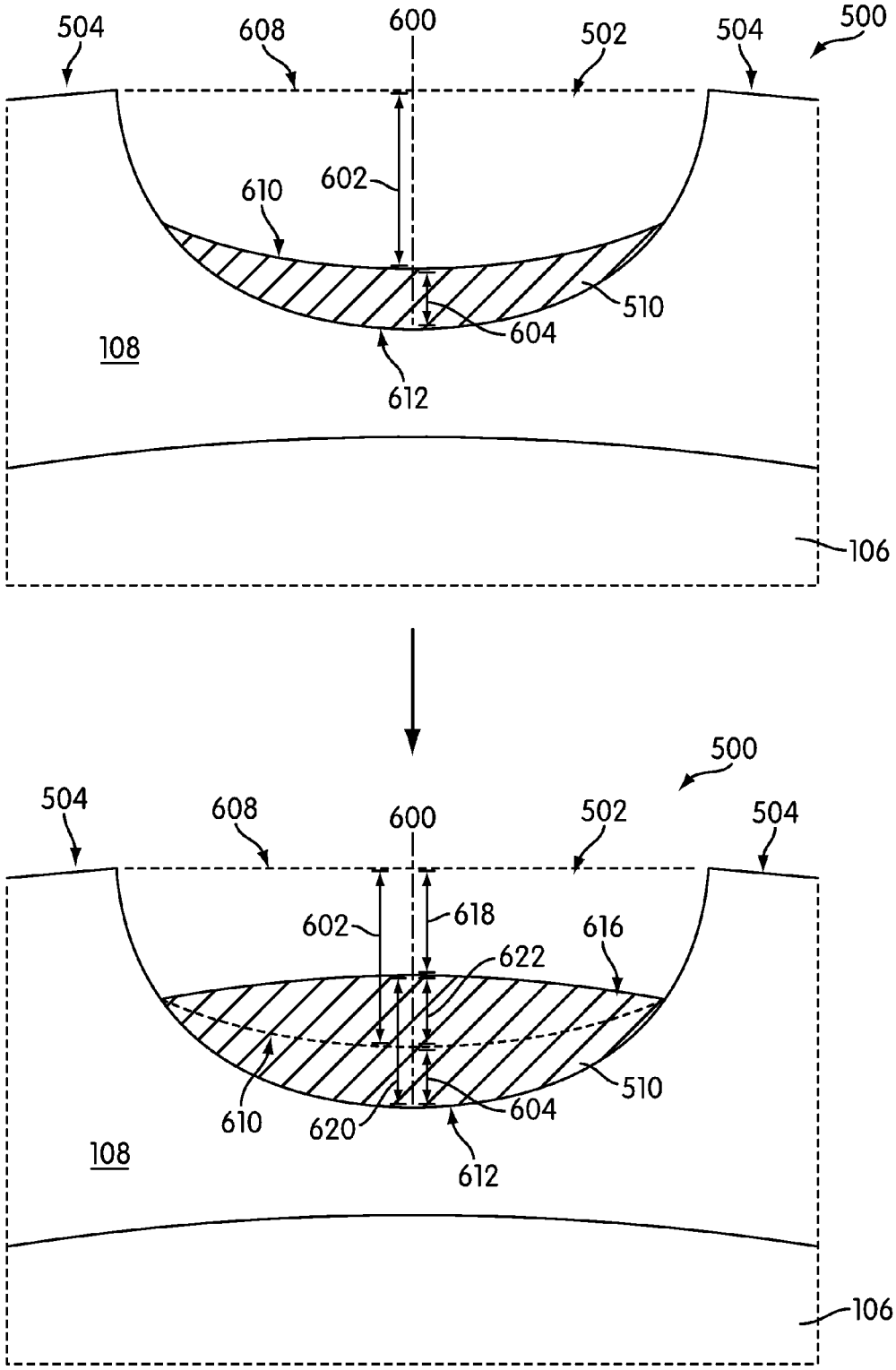
FIG. 4 shows two cross-sectional views of a single dimple on a third embodiment of a golf ball.

FIG. 4 shows a third embodiment of a golf ball 500 in accordance with the present disclosure. In this embodiment, a coating layer 510 overlaps a dimple portion 502 of cover layer 108, specifically at surface 612. Coating layer 510 does not overlap land portions 504 of cover layer 108. Coating layer 510 may overlap each dimple portion 502 on golf ball 500, such that coating layer 510 may collectively be comprised of each separate coating portion across the entirety of golf ball 500. Alternatively, coating layer 510 may overlap fewer than all dimple portions 502 on golf ball 500.

As in other embodiments discussed above, coating layer 510 may exist in a dry state as shown in the upper half of FIG. 4. The dry state is associated with first dimple depth 602, as measured between dry state dimple bottom surface 610 and line 608 at dimple center axis 600. The dry state is also associated with coating layer 510 having a dry state thickness 604, as measured between cover layer 108 surface 612 and dry state dimple bottom surface 610.

Coating layer 510 may then undergo a physical change from the dry state to a wet state, as shown in the lower half of FIG. 4. The wet state is associated with second dimple depth 618, as measured between wet state dimple bottom surface 616 and line 608 at dimple center axis 600. The wet state is also associated with coating layer 510 having a wet state thickness 620, as measured between cover layer surface 612 and wet state dimple bottom surface 616. The difference between first dimple depth 602 and second dimple depth 618 is shown as distance 622.

In addition to the change in dimple depth discussed above, the embodiment shown in FIG. 4 may also achieve other advantageous effects. In this embodiment, because coating layer 510 does not overlap land areas 504, a change in the hardness of coating layer 510 may create "zones" of differing hardness. Such hardness zones are discussed in detail in commonly-owned U.S. patent application Publication No. 2011/0177884, currently application Ser. No. 12/690,761, titled "Golf Ball With Cover Having Varying Hardness," filed Jan. 20, 2010, the disclosure of which is hereby incorporated by reference in its entirety.

Figure 5:
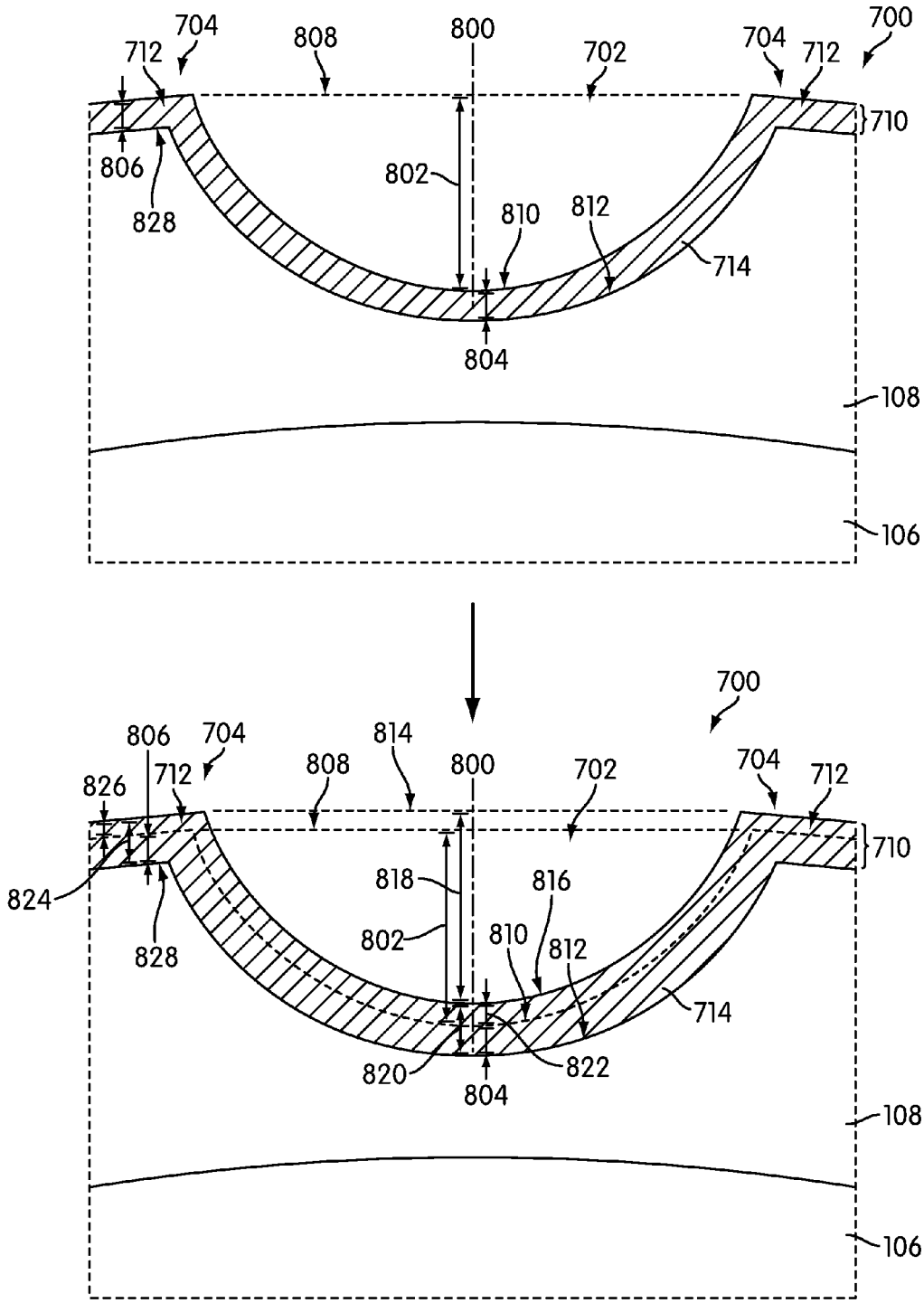
FIG. 5 shows two cross-sectional views of a single dimple on a fourth embodiment of a golf ball.

FIG. 5 shows a fourth embodiment of a golf ball 700 in accordance with the present disclosure. Golf ball 700 includes a coating layer 710 that overlaps a dimple portion 702 and land portions 704 with a uniform thickness. Namely, thickness 806 of coating layer 710 in land portions 704 is the same as thickness 804 of coating layer 710 in dimple portion 702.

In this embodiment, coating layer 710 has a uniform thickness, and coating layer 710 may be made of a uniform continuous material (thereby having a constant swelling ratio). As a result, the physical change from the dry state to the wet state does not change the dimple depth. The dry state is associated with first dimple depth 802, as measured between dry state dimple bottom surface 810 and line 808 at dimple center axis 800. The wet state is associated with second dimple depth 818, as measured between wet state dimple bottom surface 816 and line 814 defined by top surface of land areas 704. In this embodiment, distance 826 by which land portions 712 of coating layer 710 swell is the same as distance 822 by which dimple portion 714 of coating layer 710 swells. Therefore, first dimple depth 802 and second dimple depth 818 are substantially the same, as are all of thicknesses 804 and 806 (in the dry state) and thicknesses 820 and 824 (in the wet state).

Although this embodiment is not configured to change dimple depth, coating layer 710 may nonetheless undergo a desired change in hardness. The transition from the dry state to the wet state may, for example, uniformly decrease the hardness of coating layer 710. As discussed above, decreased hardness may increase the rate of spin and the degree of control that golf ball 700 experiences when hit by a golf club face.

Figure 6:
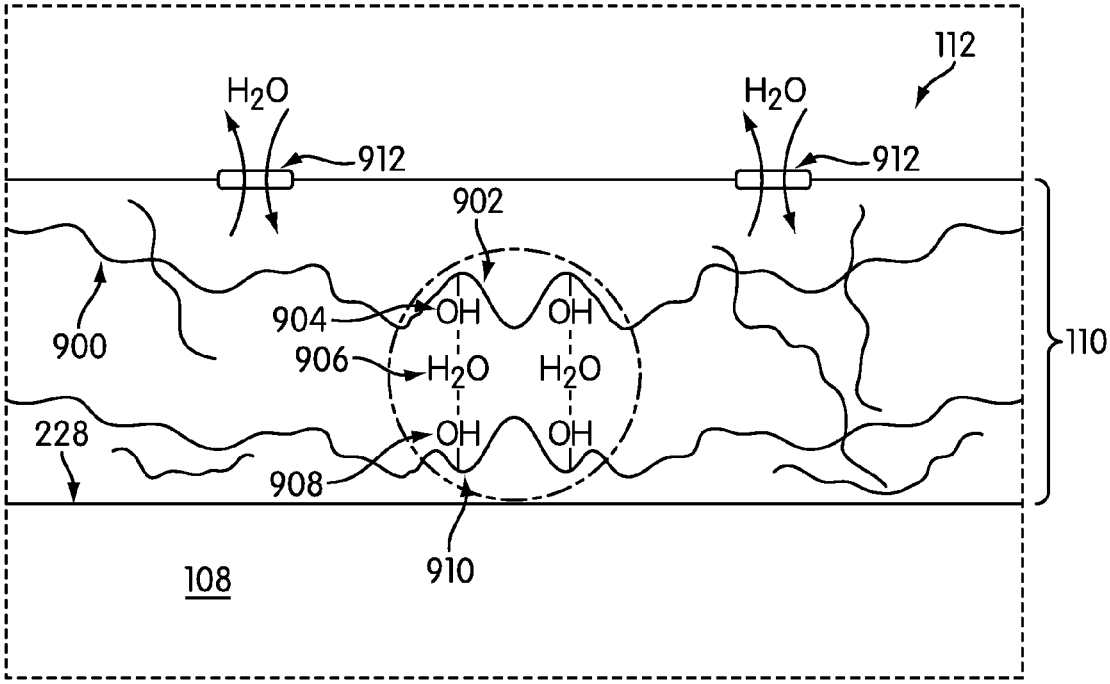
FIG. 6 shows a close-up view of the polymer molecules making up a coating layer on the golf ball of FIG. 1.

FIG. 6 shows coating layer 110 on golf ball 100 (FIG. 1) in further detail. As mentioned, coating layer 110 may be comprised of a hydrophilic water-swellable material, where a hydrophilic water-swellable material may be any material that includes polar charges on the molecules therein capable of forming hydrogen bonds with water, and that absorbs water so as to physically change dimension by swelling. Without wishing to be bound by any particular theory of action, FIG. 6 shows one mechanism by which such swelling may occur.

In FIG. 6, coating layer 110 may be made up of polymer strands 900. Polymer strands 900 as shown in FIG. 6 are merely representative of the molecular structure of a polymer material, and are not to scale. In the particular embodiment shown in FIG. 6, a first polymer strand 902 is located adjacent to a second polymer strand 910. Each of the first polymer strand 902 and the second polymer strand 910 includes free pendant hydroxyl (—OH) groups 904 and 908, respectively. Hydroxy groups 904 and 908 are capable of forming hydrogen bonds with a water molecule 906. As a result of forming these hydrogen bonds, water molecule 906 inserts itself between the otherwise closely adjacent polymer strands 902 and 910. The water molecule therefore "pushes" polymer strands 902 and 910 apart, causing coating layer 110 to swell.

In specific embodiments, the physical change from the dry state to the wet state may be reversible. Specifically, water molecules may enter into coating layer 110 through pores 912, and exit therefrom as well. Pores 912 are merely representative of the hydrophilic water-swellable material being porous, and are not to scale. Coating layer 110 may therefore transition from the dry state to the wet state upon exposure to water, and back again. The transition from the wet state back to the dry state may occur (for example) after a predetermined time period during which coating layer 110 is not exposed to water, or the transition may be effected by a specific stimulus such as heating.

Hydrophilic water-swellable polymer materials are generally known in the art of polymer chemistry. Information regarding hydrophilic water-swellable polymer materials may be found in, for example. U.S. Pat. No. 6,787,487, titled "Water Vapor-permeable and Waterproof Material and Method for Manufacturing the Same" and issued Sep. 7, 2004, to Takeda et al, the disclosure of which is hereby incorporated by reference in its entirety. Additionally, U.S. Pat. No. 5,266,669, titled "Softening Non-swelling Polyurethane" and issued Nov. 30, 1993 to Onwunaka, et al. also provides relevant information regarding hydrophilic water-swellable polymer materials, although the specific polymers disclosed therein are non-swelling. The disclosure of U.S. Pat. No. 5,266,669 is hereby incorporated in its entirety.

In specific embodiments, the hydrophilic water-swellable material is a thermoplastic polyurethane (TPU). Although thermoplastic polyurethane materials are known to be used in golf ball construction, the thermoplastic polyurethane used to form coating layer 110 must be hydrophilic and water-swellable, properties for which the polymer must specifically be manufactured.

Suitable hydrophilic water-swellable thermoplastic polyurethanes are disclosed in, for example, U.S. Pat. No. 5,334,691, titled "Hydrophilic Polyurethanes of Improved Strength," issued Aug. 2, 1994, to Gould, et al., the disclosure of which is hereby incorporated by reference in its entirety.

Other suitable hydrophilic water-swellable thermoplastic polyurethanes are disclosed in, for example, U.S. Pat. No. 6,017,625, titled "Water-absorptive polyurethane fiber and method of producing the same" issued Jan. 25, 2000 to Sato, et al., the disclosure of which is hereby incorporated by reference in its entirety.

Finally, other suitable hydrophilic water-swellable thermoplastic polyurethanes are disclosed in, for example, U.S. Patent Application Publication No. 2009/0291120, titled "Hydrophilic Polyurethane Compositions," published Nov. 26, 2009, to Tuominen et al., the disclosure of which is hereby incorporated by reference in its entirety.

The above reference are merely exemplary, and persons having ordinary skill in the art may substitute other known hydrophilic water-swellable thermoplastic polyurethane compositions, as may be suitable for the construction and purposes of the golf ball coating layers disclosed herein.

The present disclosure also provides a method of manufacturing a golf ball. Generally, the method of manufacturing a golf ball includes (1) a step of receiving a golf ball core substantially surrounded by a cover layer, the cover layer having at least one dimple and at least one land area adjacent to the dimple; and (2) a step of coating at least a dimple portion of the cover layer with a coating layer, the coating layer being comprised of a hydrophilic water-swellable material such that the coating layer is configured to physically change from a dry state to a wet state upon exposure to water.

The method produces a golf ball configured to physically change from a dry state to a wet state upon exposure to water. Specifically, the method produces a golf ball wherein the dry state is associated with a first a first dimple depth, the wet state is associated with a second dimple depth, and the second dimple depth is less than the first dimple depth; and wherein the dry state is associated with the coating layer having a first hardness, the wet state is associated with the coating layer having a second hardness, the second hardness being softer than the first hardness.

As has been discussed above with respect to the various embodiments of FIGS. 1-5, the method may coat at least a dimple portion of the cover layer. In specific embodiments, the method may coat substantially an entirety of the cover layer with the coating layer. In other embodiments, the method may coat any portion of the cover layer that is less than the entirety thereof. The coating may be carried up by any generally known coating method, such as brushing, dipping, molding or plating.

Figure 7:
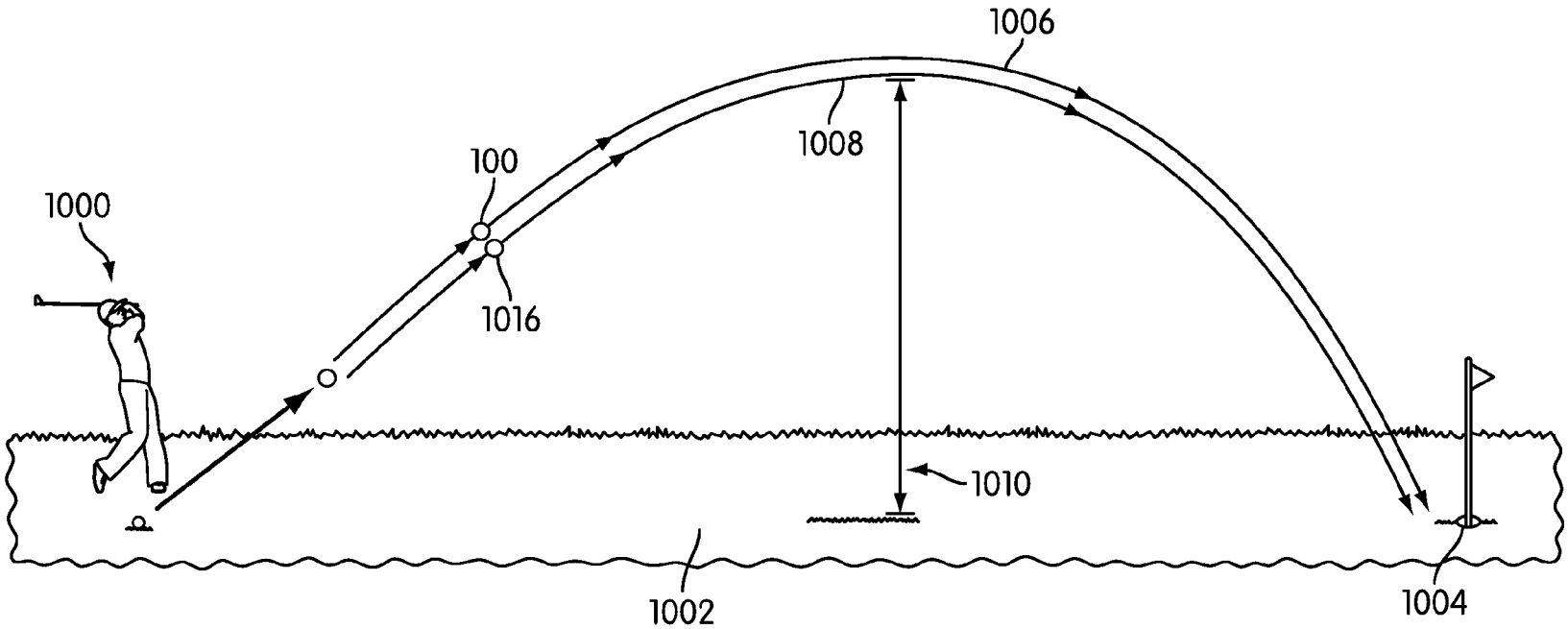
FIG. 7 shows two similar flight paths of two golf balls, after being hit by a golf club swung by a golfer, in normal weather conditions.
Figure 8:
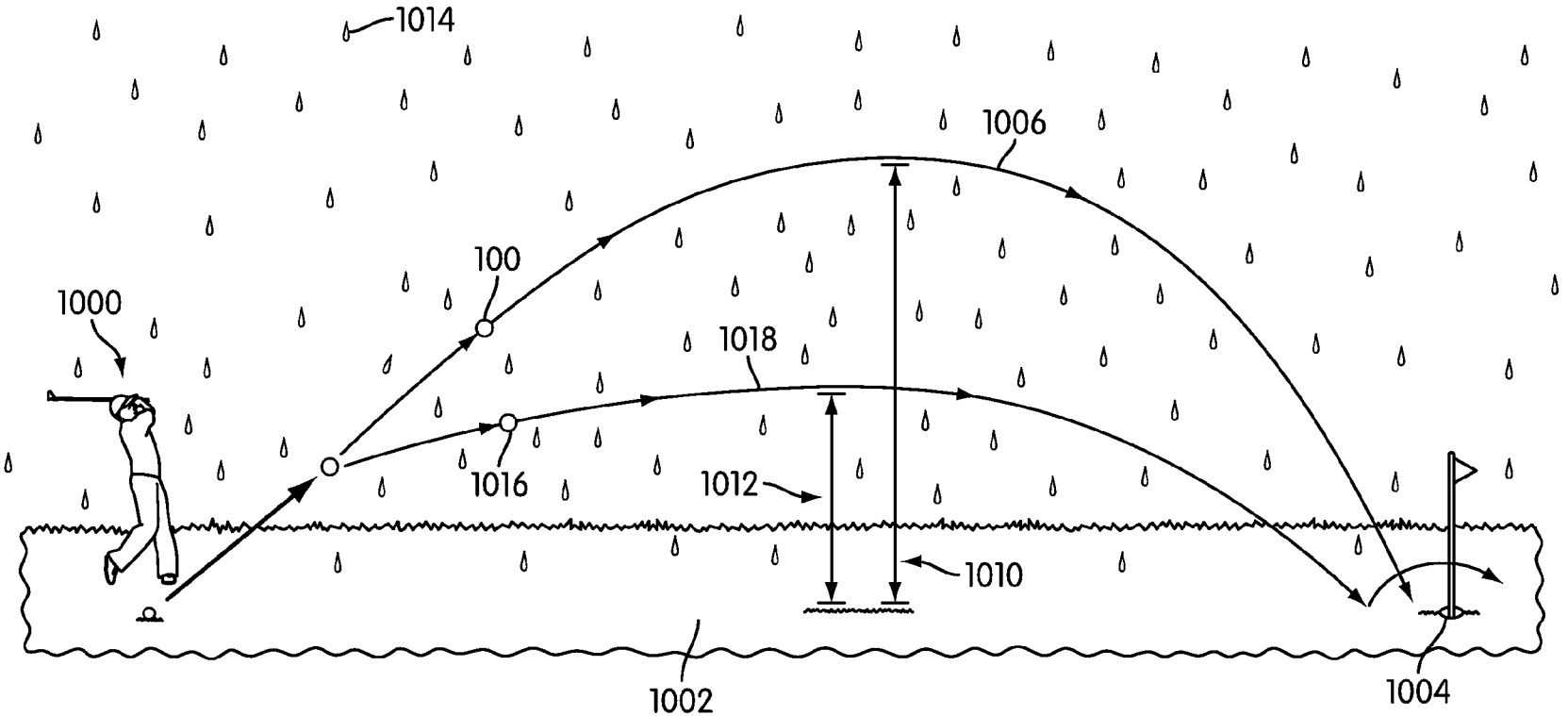
FIG. 8 shows two different flight paths of two golf balls, after being hit by a golf club swung by a golfer, in wet weather conditions.

FIG. 7 and FIG. 8 show how golf balls in accordance with the present disclosure may be used to compensate for wet weather conditions. Although not wishing to be bound by any particular usage or effect, the change in dimple depth and hardness from the dry state to the wet state may generally allow golf ball 100 to compensate for the effects of wet weather conditions that would otherwise disadvantage conventional golf balls. Specifically, during wet weather, water on a conventional golf ball may decrease the amount of friction between a golf club face and the golf ball during a shot, cause a golf ball to experience a lower trajectory flight path and reduced spin.

FIG. 7 shows a golfer 1000 golfing in fair (i.e., normal, or non-wet) weather conditions. Under these conditions, golf ball 100 is in the dry state, as shown in FIG. 1. Specifically, golf ball 100 has a first dimple depth and coating layer 110 has a first hardness value. Golf ball 100 follows flight path 1006 toward the tee 1004, achieving a maximum vertical distance of 1010. For comparison, conventional golf ball 1016 is shown following a substantially similar flight path 1008. Conventional golf ball 1016 has the same general aerodynamic properties, such as dimple depth and cover layer hardness, as golf ball 100 in the dry state.

FIG. 8 shows golfer 1000 golfing in wet-weather conditions. Specifically, rain 1014 wets golf ball 100 and golf ball 1016, as well as the green 1002. As a result of being exposed to water in the form of rain 1014, golf ball 100 undergoes a physical change from the dry state to the wet state (as shown in FIG. 1). The wet state of golf ball 100 has a second dimple depth that may be smaller than the first dimple depth, and has a second hardness that may be softer than the first hardness. As a result of the wet weather conditions, conventional golf ball 1016 experiences reduced friction between its cover layer and the golf club face during the shot. Therefore, conventional golf ball 1016 first experiences a flight path trajectory 1018 having a lower maximum height 1012. Conventional golf ball 1016 also experiences reduced spin, resulting in poor control of the shot upon landing.

In contrast, golf ball 100 in the wet state compensates for the reduced friction by having a reduced dimple depth and a softer outermost layer. The reduced dimple depth causes golf ball 100 to experience a flight path 1006 that is otherwise higher than the reduced friction would otherwise cause it to have. Furthermore, the softer outermost layer causes golf ball 100 to experience more spin than the reduced friction would otherwise cause, resulting in golf ball 100 having better control upon landing. Accordingly, the present disclosure provides golf balls which may be used equally well in both fair weather conditions and wet weather conditions.

Commonly-owned U.S. patent application Publication No. 20120/010/8361, currently application Ser. No. 12/916,955, titled "Golf Ball with Changeable Dimples", and filed on Nov. 1, 2010, discloses additional features of a golf ball with varying outer diameters of layers that may affect the dimple depth, and the disclosure of which is hereby incorporated in its entirety.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball comprising:

a core;

a cover layer substantially surrounding the core, the cover layer including at least one dimple, and at least one land area adjacent to the dimple; and a coating layer overlapping at least a portion of the cover layer;

the coating layer overlaps at least one dimple portion of the cover layer, and the coating layer overlaps at least one land area portion of the cover layer;

the coating layer has a first thickness in locations where the coating layer overlaps the at least one land area portion;

the coating layer has a second thickness in locations where the coating layer overlaps the at least one dimple portion;

the second thickness is greater than the first thickness; and wherein the coating layer is a continuous material comprised of a hydrophilic water-swellable material with a constant swelling ratio, such that the coating layer is configured to undergo a uniform physical change from a dry state to a wet state upon exposure to water;

wherein the dry state is associated with a first dimple depth, the wet state is associated with a second dimple depth, and the second dimple depth is less than about 75% of the first dimple depth.

2. The golf ball of claim 1, wherein the dry state is associated with the coating layer having a first hardness, the wet state is associated with the coating layer having a second hardness, and the second hardness is different from the first hardness.

3. The golf ball of claim 2, wherein the second hardness is softer than the first hardness.

4. The golf ball of claim 2, wherein the second hardness is at least about 5 units on the Shore D scale softer than the first hardness.

5. The golf ball of claim 1, wherein the hydrophilic water-swellable material is a thermoplastic polyurethane.

6. The golf ball of claim 1, wherein the physical change from a dry state to a wet state is reversible.

7. The golf ball of claim 1, wherein the coating layer overlaps substantially an entirety of the cover layer.

8. The golf ball of claim 1, wherein the second dimple depth is less than about 50% of the first dimple depth.

9. The golf ball of claim 1, wherein the second dimple depth is less than about 33% of the first dimple depth.

10. A golf ball comprising:

a core;

a cover layer substantially surrounding the core, the cover layer including at least one dimple, and at least one land area adjacent to the dimple; and a coating layer overlapping at least a dimple portion of the cover layer; the coating layer overlaps at least one dimple portion of the cover layer, and the coating layer overlaps at least one land area portion of the cover layer;

the coating layer has a first thickness in locations where the coating layer overlaps the at least one land area portion;

the coating layer has a second thickness in locations where the coating layer overlaps the at least one dimple portion;

the second thickness is greater than the first thickness;

wherein the coating layer is comprised of a hydrophilic water-swellable material having a constant swelling ratio, such that the coating layer is configured to uniformly physically change from a dry state to a wet state upon exposure to water;

the dry state is associated with a first a first dimple depth, the wet state is associated with a second dimple depth, wherein the second dimple depth is less than the first dimple depth, the second dimple depth being less than about 75% of the first dimple depth; and the dry state is associated with the coating layer having a first hardness, the wet state is associated with the coating layer having a second hardness, wherein the second hardness is softer than the first hardness.

11. The golf ball of claim 10, wherein the second dimple depth is less than about 50% of the first dimple depth.

12. The golf ball of claim 10, wherein the second hardness is at least about 5 units on the Shore D scale softer than the first hardness.

13. The golf ball of claim 10, wherein the physical change from a dry state to a wet state is reversible.

14. The golf ball of claim 10, wherein the hydrophilic water-swellable material is a thermoplastic polyurethane.

15. The golf ball of claim 10, wherein the second dimple depth is less than about 33% of the first dimple depth.

* * * * *